US007422122B2

(12) United States Patent
Holland

(10) Patent No.: US 7,422,122 B2
(45) Date of Patent: Sep. 9, 2008

(54) HOCKEY STICK RACK

(76) Inventor: John Holland, 205 Dundas St. East, Belleville, Ontario (CA) K8N 5A2

( * ) Notice: Subject to any disclaimer, the term of this patent is extended or adjusted under 35 U.S.C. 154(b) by 9 days.

(21) Appl. No.: 11/334,298

(22) Filed: Jan. 19, 2006

(65) Prior Publication Data

US 2007/0163975 A1 Jul. 19, 2007

(51) Int. Cl.
*A47F 7/00* (2006.01)

(52) U.S. Cl. ..... 211/85.7; 211/196; 211/60.1

(58) Field of Classification Search ..... 211/85.7, 211/60.1, 70.5, 189, 195, 175, 207, 107, 211/205, 196
See application file for complete search history.

(56) References Cited

U.S. PATENT DOCUMENTS 4,807,763 A * 2/1989 Jankovsky ..... 211/60.1
5,285,906 A * 2/1994 Wisnowski et al. ..... 211/70.5
5,335,794 A * 8/1994 Reedy ..... 211/85.7
5,829,604 A * 11/1998 Brophy ..... 211/70.2
6,431,627 B1 * 8/2002 Tomeny ..... 294/163
6,547,085 B2 * 4/2003 Belisle ..... 211/85.7
6,695,154 B2 * 2/2004 Jacobs ..... 211/85.7
6,752,278 B2 * 6/2004 Craft et al. ..... 211/85.7
2002/0113030 A1 * 8/2002 Belisle ..... 211/85.7
2003/0178383 A1 * 9/2003 Craft et al. ..... 211/85.7
2003/0196973 A1 * 10/2003 Jacobs ..... 211/85.7
2007/0102383 A1 * 5/2007 Evans et al. ..... 211/85.7

* cited by examiner

*Primary Examiner*—Jennifer E. Novosad

(57) ABSTRACT

The invention is a rack holding hockey sticks and other sporting equipment. The base is comprised of a member to which is attached at right angles another two members on opposite sides and a post rising vertically from the point of attachment. A second vertical member slides over the first vertical member. Near the top of the second vertical member are attached two members. Attached to these two members are two additional members at right angles. To each of those members are attached a plurality of other members at right angles projecting outwards. There are two additional members attached lower on the second vertical member. Each of these members have an additional member attached at right angles and a plurality of members attached to such member at right angles, which members extend inwards towards the vertical member.

10 Claims, 3 Drawing Sheets

HOCKEY STICK RACK

BACKGROUND OF INVENTION

1. Field of the Invention

This invention is a device for holding and storing hockey sticks and other sporting equipment which have long handles.

Devices for holding and storing hockey sticks and other sporting equipment are available. Those devices have generally provided for methods of holding the sticks horizontally but not vertically or have not been portable or have not had a method of ensuring that the hockey sticks do not fall out of the storage device or rack that does not involve opening and closing the stick holder. Although there are various holding and storage devices, there is need for a device which will hold the hockey sticks or other sporting equipment in a vertical position, ensure that they do not fall over or out of the device, even when hit and which is easily transported and portable.

2. Description of Prior Art

The prior art has included devices for storing and holding hockey sticks. These are devices which generally have an opening only in one direction or hold them only at one end of the hockey stick or have no method of keeping the hockey sticks from falling over except those devices which have had methods which require the mechanism to be open and closed prior to insertion and removal. There is no device which allows the hockey stick to be placed vertically into the rack and effectively locking it in place and preventing it from falling over by nothing more than inserting the stick in the rack and which allows removal on the same basis without having to clamp, unclamp or otherwise deal with the hockey stick and which device is free standing, portable and can be disassembled.

U.S. Pat. No. 6,431,627 issued to Tomeny is a hockey stick carrier providing for the horizontal storage of hockey sticks. If one end of the stick is bumped, then the hockey stick will jump out of the rack and fall on to the floor. The device cannot be disassembled for easy transport.

U.S. Pat. No. 6,752,278 issued to Craft, Stitchick and Gormley is a storage equipment rack. Although the device provides for vertical storage of hockey sticks and other sporting goods, there is no provision for locking the bottom end of the hockey stick in place, allowing the bottom end to slide within the device. The device cannot be disassembled and it is not portable.

U.S. Pat. No. 5,335,794 issued to Reedy is a rack with a hoop and hook assembly to hold sports equipment such as hockey sticks. The subject device is permanently fixed in place and is not portable and cannot be disassembled. It only holds the one end of the stick, allowing the other end of the stick to swing freely unlike the subject invention.

Similarly, U.S. Pat. No. 6,547,085 issued to Belisle has similar differences in that the openings for the hockey stock both face in the same direction, the base is significantly larger than the subject invention and occupies significant space in the dressing room. The only method of locking the sticks in place is to put a bar or strap over the sticks holding it in place, which must be opened and closed each time a stick is inserted or removed, unlike the subject invention.

BRIEF SUMMARY OF THE INVENTION

The invention is a device for holding and storing hockey sticks and other sporting equipment with long handles. The base of the invention is composed of a member to which two members are joined at right angles at the middle of the first member. The base rests on the surface upon which the device rests. At the joining point of the three members, a further member is attached which extends vertically from the base. In the preferred embodiment, over this vertical member would be inserted another member also rising vertically whose inside diameter is equal to the outside diameter of the first vertical member. This second vertical member slides over the first vertical member to lock it into place. To this second vertical member is attached at or near the top of the member two further members on opposite sides of such second vertical member. These extend out parallel to the surface on which the device rests. To each of these members is attached a further member at right angles. These two members are therefore parallel to each other. To each of these members on the side furthest from the second vertical member are attached a plurality of further members at right angles to such member. To the second vertical member are attached two more members closer to the surface upon which the invention rests than the members attached near the top of the second vertical member. These are on opposite sides of the second vertical member and on the same sides as the second vertical member as the two members attached near the top of the second vertical member. They are also longer than the two members attached near the top of the second vertical member. They are also parallel to the surface and therefore parallel also to the top two members. To these attached at right angles are two further members. These two further members are parallel to each other. To these members are attached on the side closest to the second vertical member a plurality of members at right angles.

The members may be hollow or solid. The members may be round, square or in another shape and may be made of various materials, including wood, steel and plastic.

A hockey stick is loaded into the subject device by inserting the hockey stick between two of the plurality of members on the lower attachment to the second vertical member and resting the top of the hockey stick between two of the plurality of members attached to the upper end of the second vertical member. The members on either side of the hockey stick, prevent movement from side to side and the opposed nature of the top and bottom members of the attachment prevents the hockey stick from moving forward or backwards.

DETAILED DESCRIPTION OF THE INVENTION

Figure 1:
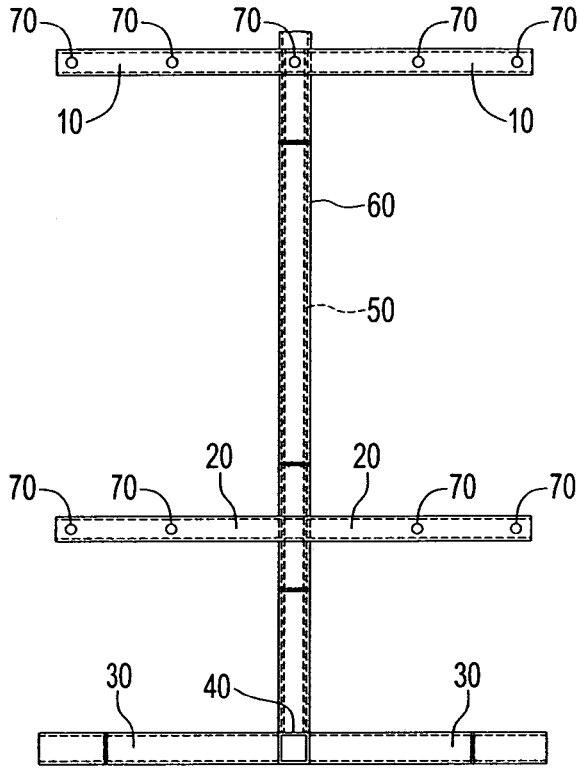
FIG. 1 is a perspective view from the front of the device.
Figure 2:
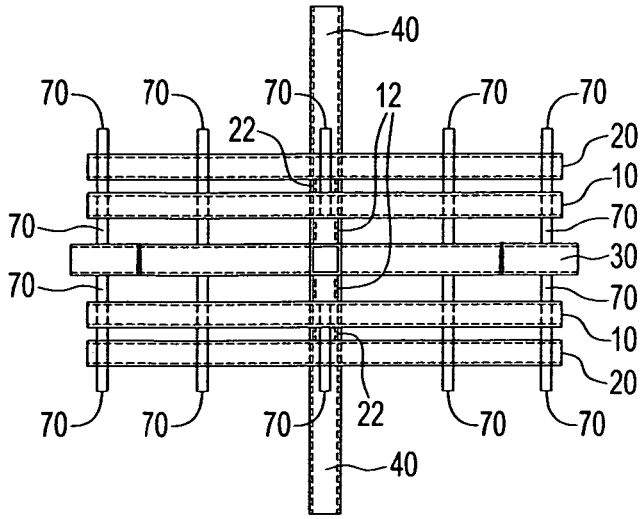
FIG. 2 is a perspective view of the device from the top looking straight down at the device.
Figure 3:
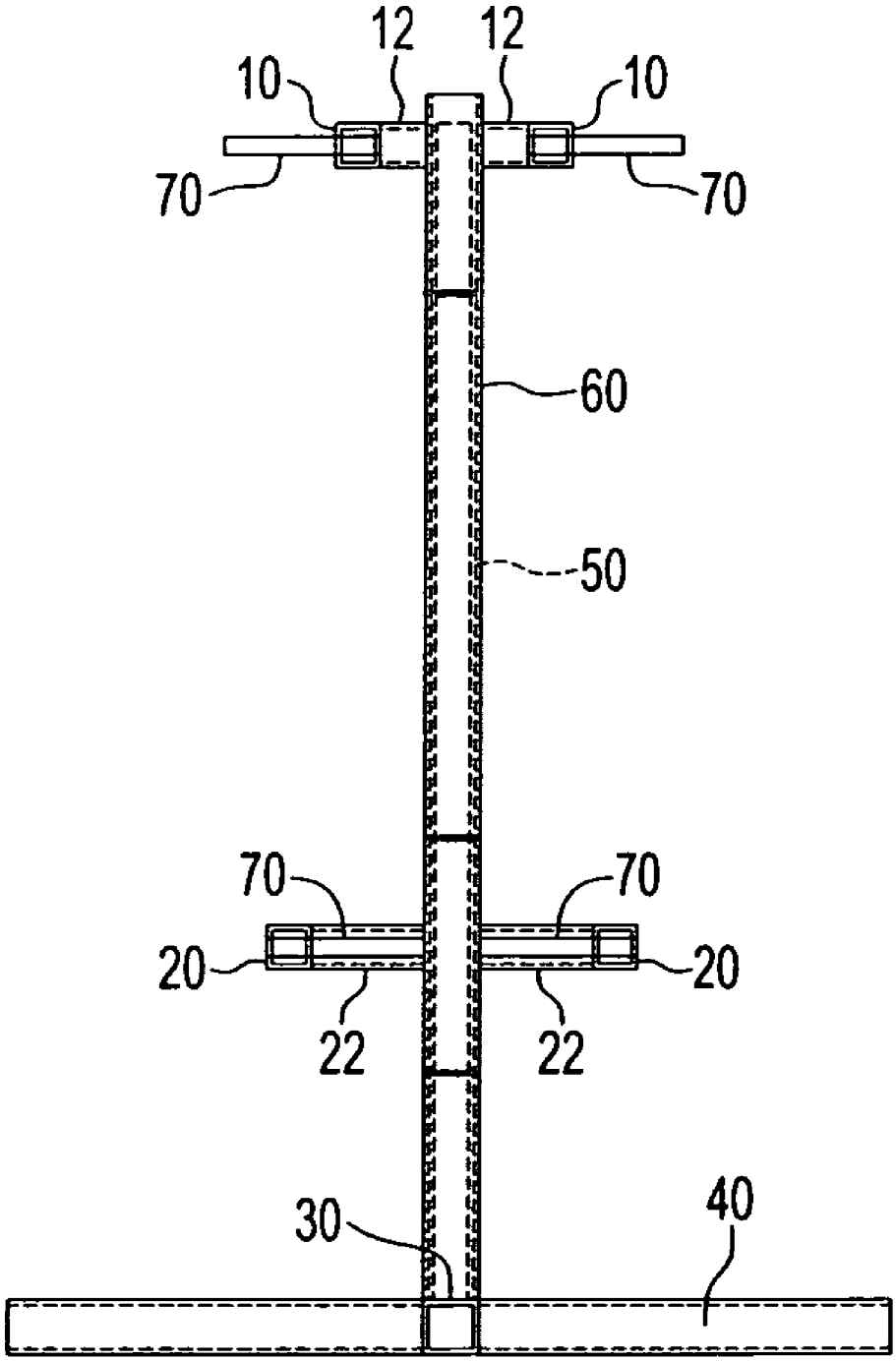
FIG. 3 is a perspective view from the side of the device.
Figure 4:
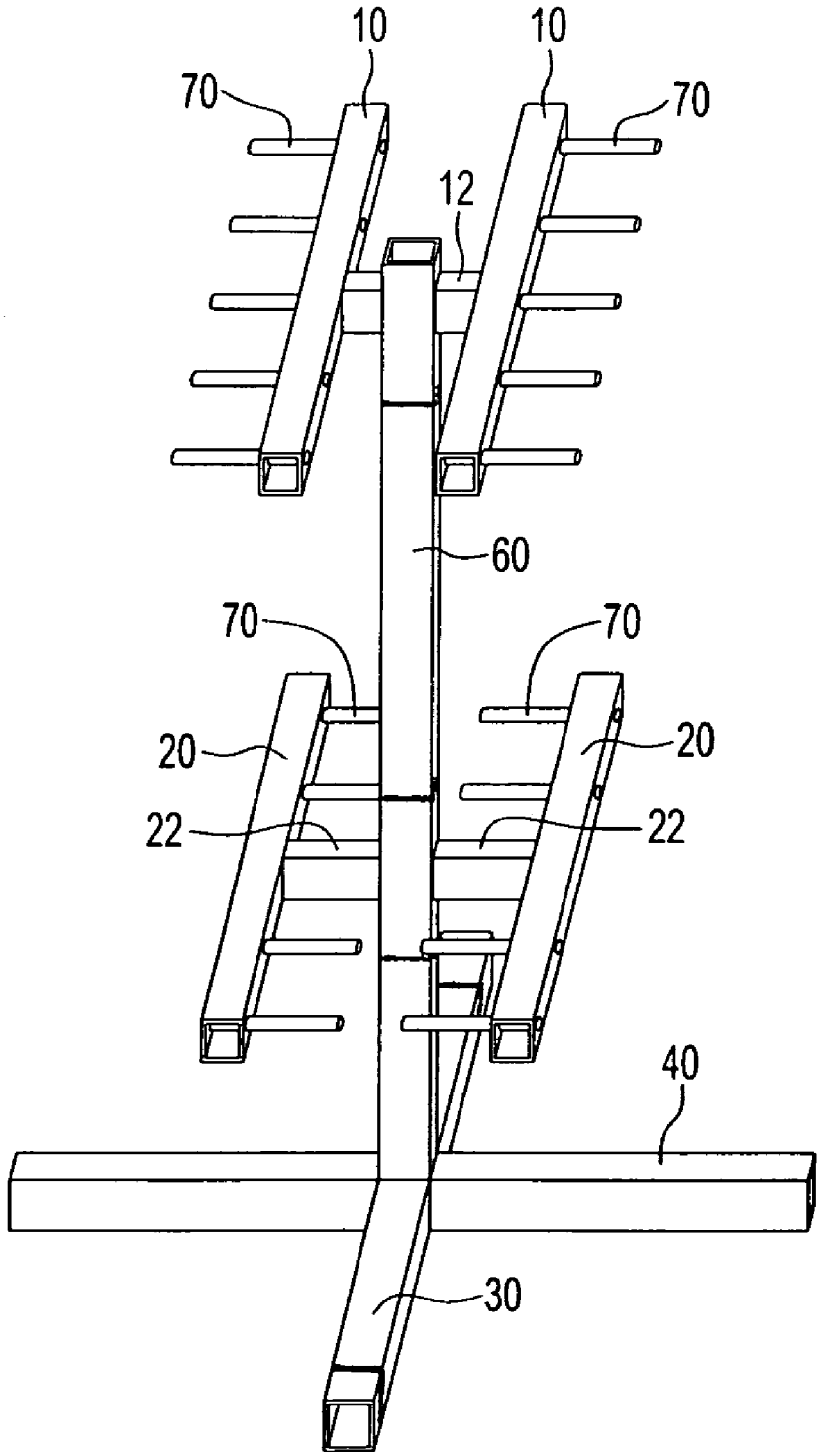
FIG. 4 is an isometric view looking down at the device from the side but standing slightly to the front of the device allowing the device to be viewed in a three dimensional aspect.

In the preferred embodiment of the invention illustrated in FIG. 4, a member (40) is attached to two members (30) which are attached to the mid-point of the first member (40) on opposite sides and extend at right angles from the first member (40) to form the base of the device. In the preferred embodiment, there is attached a vertical member (50) as illustrated in FIG. 1 which is attached to the first member (40) at the centre and extends vertically from the point of attachment. The member (50) has an outside diameter which is equal to or slightly less than the inside diameter of the vertical member (60) which is attached to it and slides over it (60) in the preferred embodiment as illustrated in FIG. 1, which member (60) is the outside vertical member. Attached to the outside vertical member at or near the top of the outside vertical member (60) are two members (12) attached at right angles and parallel to the base member (40). These are attached on the opposite sides to the outside vertical member (60). To these members (12) are each attached at right angles a further member (10). These two members (10) are horizontal to the surface upon which the device rests including the base member (40). The two members (10) are parallel to each other. To each of these parallel members (10) are attached a plurality of further members (70). These plurality of further members are attached to the surface of the two horizontal members (10) which is farthest from the outside vertical member (60) and extend away from the outside vertical member (60). They are attached at right angles and parallel to the surface on which the device rests. Attached to the outside vertical member (60) between the base and the upper attached members (12) are two further members (22) attached on opposite sides of the outside vertical member (60) and parallel to the surface upon which the device rests. These two further members (22) are also parallel to and attached to the same sides of the outside vertical member (60) as the two members (12) attached near the top of the outside vertical member. To these members (22) are attached at right angles two further members (20) which members are also parallel to the surface on which the invention rests. These horizontally attached members (20) are parallel to each other. Attached to each of these horizontal members (20) are a plurality of further members (70) attached to the side of the horizontal members (20) which are closest to the outside vertical member (60) and extending inwards towards the outside vertical member (60). These members (20) are attached at right angles to the two horizontal members (20) and parallel to the surface on which the invention rests.

In the most advantageous application, the outside vertical member (60) is inserted over the inside vertical member (50) locking the device into place. However, for transport, the outside vertical member is raised vertically and removed breaking the device into two pieces allowing for ease of transport and storage. In other applications, the outside vertical member (60) and the inside vertical member (50) can be made into one piece locking the device permanently in place, or the outside vertical member can be split into two or three pieces with the splits occurring between the upper and lower attachments to the outside vertical member (60).

The lower horizontal and parallel members (20) are further in distance from the outside vertical member (60) than the upper horizontal and parallel members (10) allowing for the insertion of the hockey sticks in a vertical position, but still locked in place.

It will be apparent that various changes and modifications can be made without departing from the scope of the invention as defined in the claims. For example, the members may be square or round. The members may also be hollow or solid. The members may also be other shapes. The members may be made of various materials including metal, plastic and wood. The plurality of members can be increased or decreased allowing the device to hold a greater or lesser number of sticks. As well, the position of the horizontal members which are parallel to each other, one near the top and the other near the bottom of the device, may be moved up or down or varied in height and distance apart. In addition, the base can be in other shapes such as a single square piece on a flat plane resting on the surface on which the invention rests and to which is attached the vertical member.

The embodiments of the invention in which an exclusive property or privilege is claimed are defined as follows:

1. A rack for the holding and storage of hockey sticks and other sporting equipment having elongated handles comprising:

a base having a main member which is attached to two supporting members which are attached to the mid-point of the main member on opposite sides and extend at right angles from the main member to form the base of the rack;

a vertical post having a lower member which is attached to the base at the centre of the base and extends vertically upwards and an upper member which is attached to the lower member and extends vertically from the lower member and slides over the lower member;

two upper bars each attached at right angles to the upper member of the vertical post by a connecting member and which two upper bars are parallel to the main member of the base on the opposite sides of the upper member of the vertical post;

a plurality of stick separation pins attached to the side of the two upper bars which is farthest from the upper member of the vertical post at right angles and parallel to the surface on which the rack rests;

two lower bars each attached at right angles to the lower member of the vertical post by a connecting member on opposite sides of the lower member and parallel to the surface upon which the rack rests;

a plurality of stick separation pins attached to the side of the two lower bars which is closest to the upper member of the vertical post at right angles to the two lower bars and parallel to the surface on which the rack rests;

the lower bars are disposed further in distance from a top end the upper vertical member of the post than the upper bars allowing for the insertion of the hockey sticks in a vertical position, and being locked in place.

2. The hockey stick rack as defined in claim No. 1 where the members are hollow.

3. The hockey stick rack as defined in claim No. 1 where the members are square.

4. The hockey stick rack as defined in claim No. 1 where the members are made of plastic.

5. The hockey stick rack as defined in claim No. 1 where the members are made of metal.

6. The hockey stick rack as defined in claim No. 1 where the members are made of wood.

7. The hockey stick rack as defined in claim No. 1 where the stick separation pins attached to the two lower bars extend inwards from the inner surface of the two lower bars and the stick separation pins attached to the two upper bars extend outward and are attached to the outer surface of the two upper bars.

8. The hockey stick rack as defined in claim No. 1 where the upper member of the vertical post is comprised of two members which attach to each other at a point between the upper bars and the lower bars.

9. The hockey stick rack as defined in claim No. 1 where the upper member of the vertical post is comprised of three members comprising a bottom member ending just above the lower bars, a top member ending just below the top bars, and a middle member.

10. The hockey stick rack as defined in claim No. 1, where the base of the device is split into three pieces comprising the main member to which are attached at the mid point of the main member the two supporting members at right angles to the main member and on opposite sides of the main member, and two additional members which attach to the two supporting members to extend their length.

* * * * *